United States Patent [19]

Nemesi

[11] 4,092,088

[45] May 30, 1978

[54] CENTRIFUGAL FAN ENCLOSURE

[75] Inventor: Steve A. Nemesi, Minnetonka, Minn.

[73] Assignee: General Resource Corp., Minneapolis, Minn.

[21] Appl. No.: 757,597

[22] Filed: Jan. 7, 1977

[51] Int. Cl.[2] ..... F04B 17/00

[52] U.S. Cl. ..... 417/360; 415/201; 415/219 C; 417/423 R; 417/362

[58] Field of Search ..... 417/423 R, 360, 362; 415/201, 219 C; 62/298

[56] References Cited

U.S. PATENT DOCUMENTS

| | | | |
|---|---|---|---|
| 2,331,958 | 10/1943 | Breese et al. | 417/360 |
| 2,458,045 | 1/1949 | Angus | 417/360 |
| 2,798,660 | 7/1957 | Flynn | 417/360 |
| 2,810,514 | 10/1957 | Patrick | 415/219 C |
| 3,305,163 | 2/1967 | Saeppard | 417/360 |
| 3,412,929 | 11/1968 | Greenheck | 415/201 |
| 3,425,621 | 2/1969 | Greenheck | 417/362 |
| 3,584,968 | 6/1971 | Keith | 417/362 |
| 3,650,633 | 3/1972 | Benoit | 417/362 |
| 3,871,795 | 3/1975 | Habdo et al. | 417/360 |

*Primary Examiner*—C. J. Husar
*Attorney, Agent, or Firm*—Paul L. Sjoquist

[57] ABSTRACT

Apparatus for housing a centrifugal fan and providing an enclosure for coupling into a ducting network, wherein the fan and driving motor is mounted on a honeycomb-style base which is slidable into and out of the enclosure, and which has an angled edge lip for engaging against a mating edge lip on the enclosure for providing a hinge means for pivotally supporting the fan and motor assembly.

9 Claims, 5 Drawing Figures

11
10
12
15
18
16
25
36
30
37
33
35
39
38
32
31
34
27
41b
40
20
41a 11
10
12
18
25
30
33
31
39
34

FIG. 3
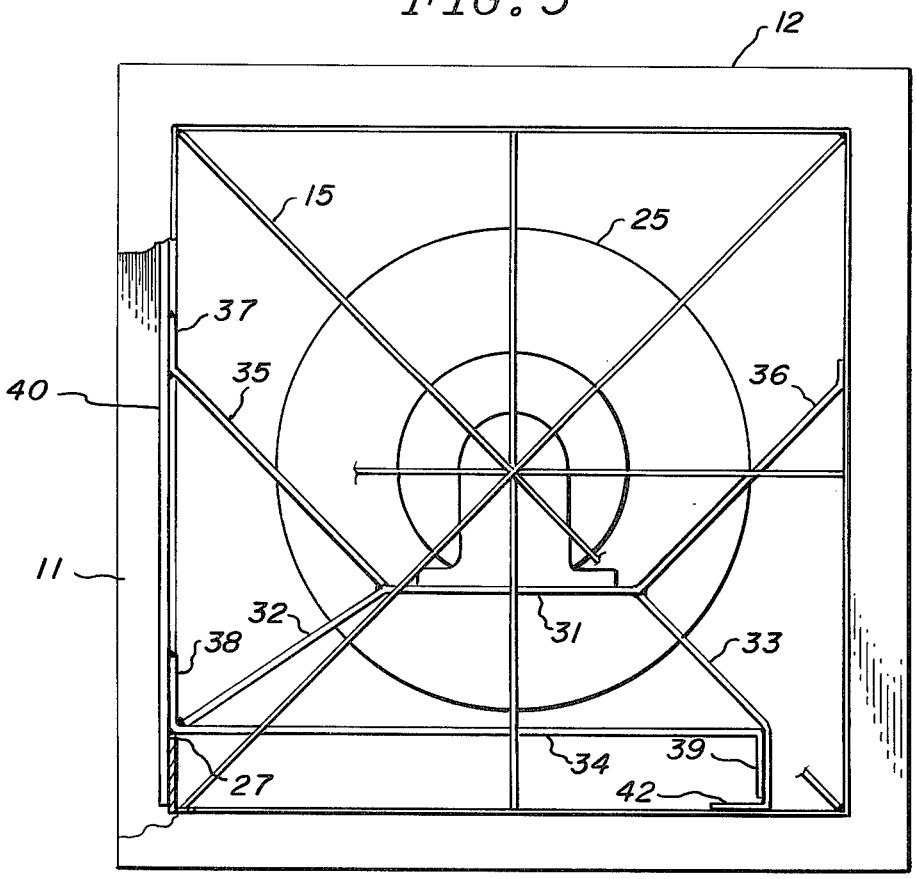
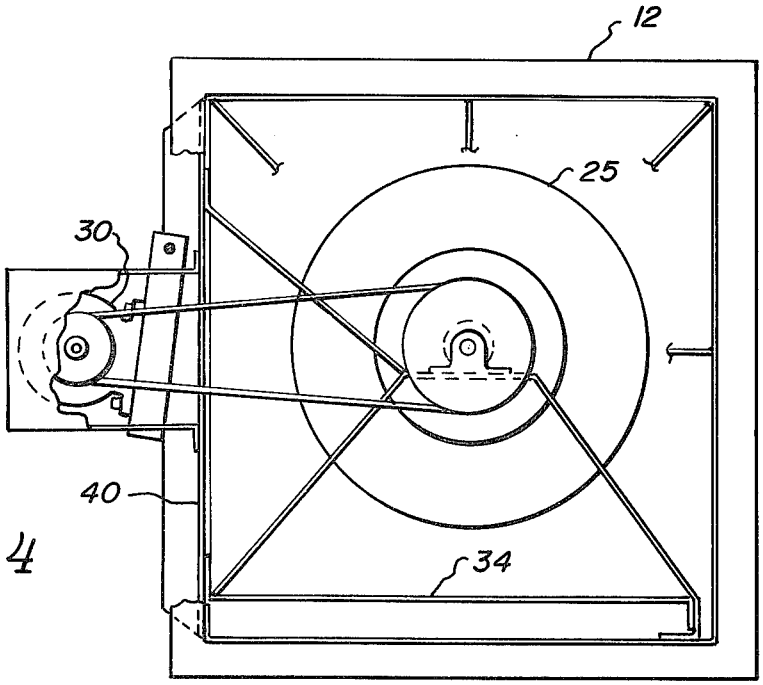
FIG. 4

CENTRIFUGAL FAN ENCLOSURE

BACKGROUND OF THE INVENTION

The controlled movement of air has become a problem of major significance to modern buildings and structures of all types. For example, heating and air cooling systems require the controlled circulation of air through a building, and pollution and other air quality equipment requires the sealed transfer ducting of gases and dust-laden air through a controlled filter network. In any air movement system one or more blowers or fans may be found at some point or points along the circulation path. Frequently, in long ducting paths, it becomes necessary to insert supplementary booster fans into the ductwork in order to maintain continuous air flow at a specified level.

Fans and other air movements devices have not changed significantly over the years, although design improvements have led to units which move air more efficiently and at controlled volume flow rates.

In any application involving movement of air through closed ducting systems, provision must be made for the installation and removal of suitable fans and blowers. These installations are preferably made in a manner which provides easy access to the moving parts so that such parts may be readily cleaned, repaired or maintained. Prior art devices have accomplished this result by structuring blower enclosures and assemblies having hinged doors with removable blower and motor assemblies. For example, U.S. Pat. No. 3,425,621, issued Feb. 4, 1969, discloses an inline centrifugal fan with a hinged door, wherein the fan and motor assembly is attached to the door for swingable movement relative to the enclosure. When the door is closed the fan is swung into position adjacent an inlet opening and is ready to operate. When the door is open the entire assembly swings away from the enclosure for maintenance or other purposes. If the blower or motor is to be replaced the assembly must be unbolted from the hinged door and removed. This patent also discloses an alternative embodiment wherein the fan is mounted internal the enclosure and the motor is mounted external the enclosure and coupled to the fan via a belt. The same principle is used with this structure, i.e. the fan and motor are attached to a hinged door for access purposes.

SUMMARY OF THE INVENTION

The present invention is an improvement over the disclosure of U.S. Pat. No. 3,425,621, and other similar inventions, in that an apparatus is provided for access to the moving parts of an inline fan assembly by merely opening a door on the side of an enclosure, thus permitting the fan and motor to be pivotally hinged open for easy access. In addition to these features the present invention provides a means for easy removal of the entire fan and motor assembly from the enclosure without removal of additional mechanical parts, the fan and motor assembly being formed into an integral unit attached to the removable door and further being designed for improved air movement efficiency within the enclosure. The invention also includes a plurality of supporting members internal the enclosure which aid in the directional flow control of the air inside the enclosure by reducing cross-current air flow and reducing eddy currents. The removable feature of the present invention is accomplished without the necessity of providing a door hinge, thereby reducing the overall costs of the inline centrifugal fan enclosure.

BRIEF DESCRIPTION OF THE DRAWINGS

A preferred embodiment of the invention is disclosed in the attached specification, and may be readily understood from the description therein and from the appended drawings, in which:

FIG. 3 shows an end view of the invention; and FIG. 4 shows an end view of an alternative embodiment of the invention.

DESCRIPTION OF THE PREFERRED EMBODIMENT

Figure 1:
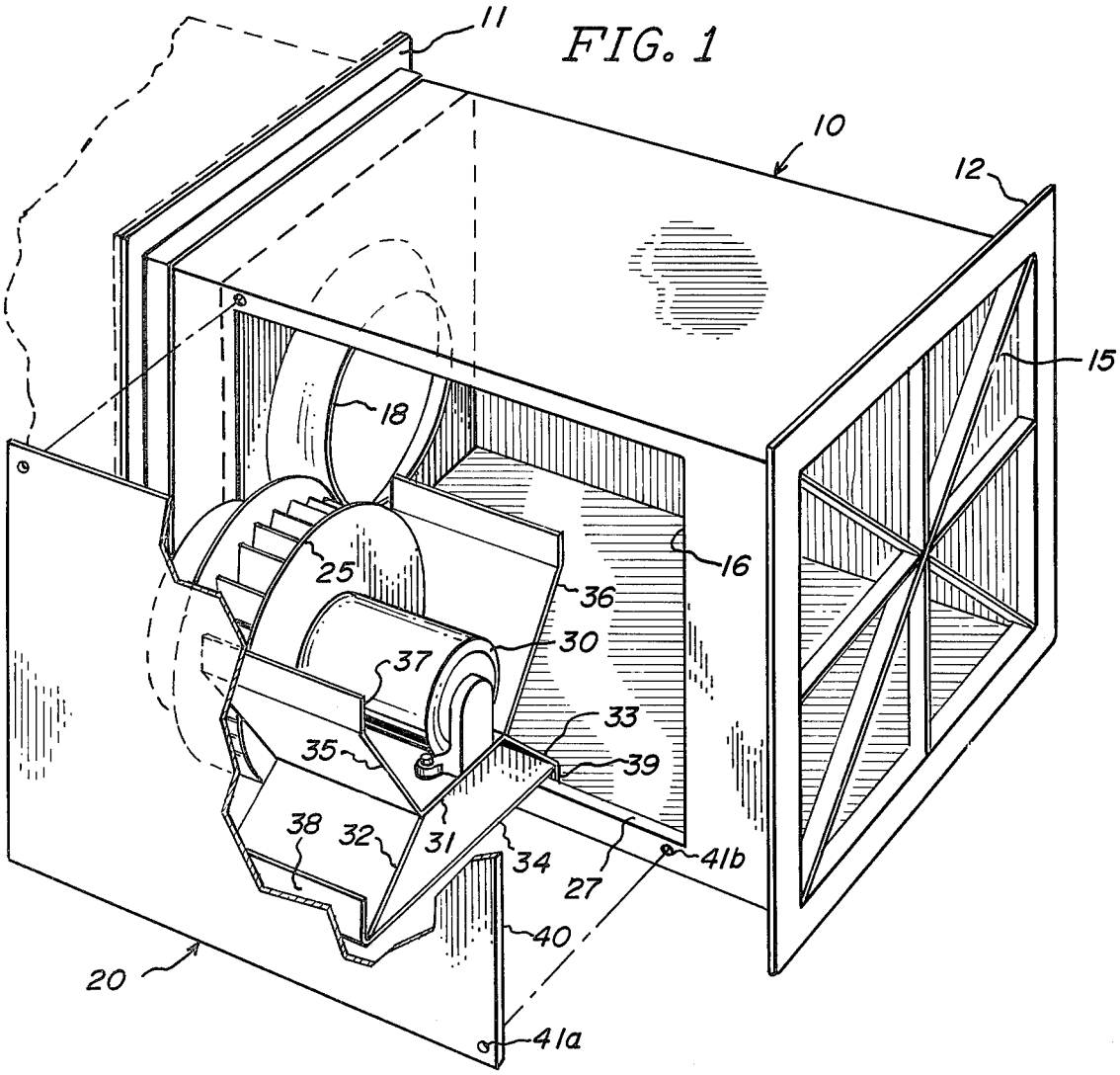
FIG. 1 shows the invention in isometric view with the fan assembly extended.

Referring first to FIG. 1, the invention is shown in isometric view with the fan assembly 20 partially opened from the enclosure 10. Enclosure 10 has a front flange 11 and a rear flange 12 adapted for attachment to a ducting system, which system would have the same relative square or rectangular measurements as enclosure 10. The attachment of flanges 11 and 12 are accomplished according to principles which are well knwon in the art.

A plurality of vanes 15 are positioned inside of enclosure 10 at or near the rear flange 12. Vanes 15 provide structural support to enclosure 12, but also provide air directional flow control for assisting in the linear longitudinal movement of air down the ducting system. Each of the vanes 15 is typically 2 – 3 inches in width to provide a flow-directing surface directed along the axis of the duct, which surfaces tend to improve downstream linear air movement. Further, vanes 15 reduce the eddy currents which are present inside of enclosure 10, particularly in the regions around the inside enclosure corners. The overall effect of providing vanes 15 in enclosure 10 is an improved air flow efficiency of 5% or greater.

One side of enclosure 10 has a rectangular opening 16 which provides an access hole for inserting fan assembly 20 into enclosure 10. The front of enclosure 10 has a circular inlet opening 18 which has an inwardly directed flange for directing air most efficiently toward the fan 25. When fan assembly 20 is correctly inserted into enclosure 10 a small gap, in the range of ½ inch or less, exists between the inner edge of inlet opening 18 and the outer projection of fan 25.

Fan 25 is driven by an electric motor 30 which is bolted to a motor assembly plate 31. Plate 31 is attached to an angled support plate 32 and a second angled support plate 33, and a cross plate 34 extends between and is rigidly attached to plates 32 and 33. Motor assembly plate 31 is also attached to an angled support plate 35 and a further angled support plate 36. An extension 37 is formed in substantial vertical alignment position, by either bending angled support plate 35 appropriately, or by welding an additional member to plate 35. A further extension 38 is similarly formed and attached to angled support plate 32. Extensions 37 and 38 are rigidly attached to a door plate 40, preferably by means of welding. Door plate 40 is sized to enclose and cover opening 16, and suitable mounting holes **41*a*, 41*b*, etc. are provided in door plate 40 and enclosure 10 so that the fan assembly 20 may be securely bolted to enclosure 10**. It should be noted that cross plate 34 is slidable over enclosure edge 27 which forms the bottom edge of opening 16. A vertical support member 39 is attached to cross plate 34 also provides support for fan assembly 20 in a manner which will be hereinafter disclosed with reference to FIG. 3.

Figure 2:
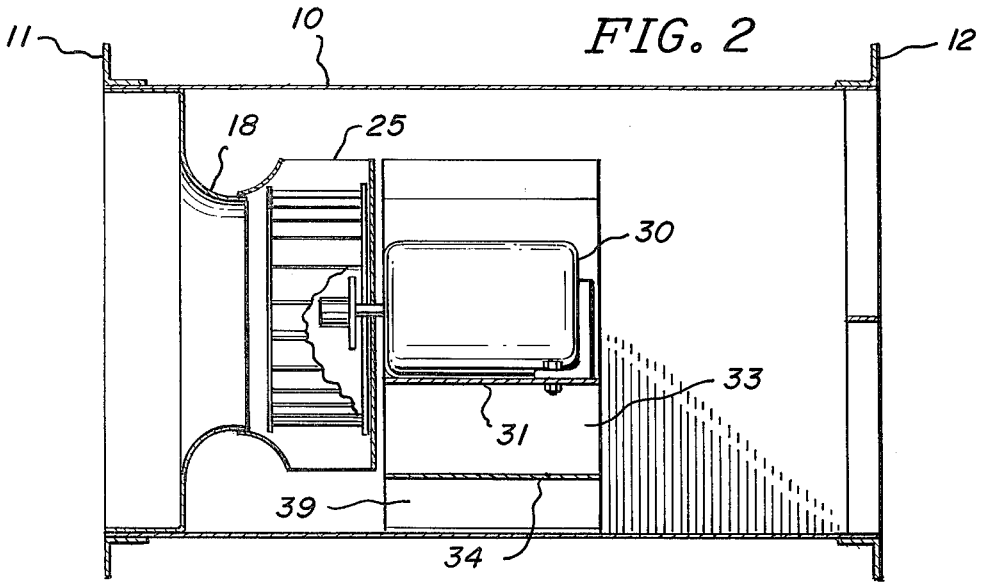
FIG. 2 shows a side view of the fan assembly.

FIG. 2 shows a side view of fan assembly 20 inside enclosure 10, illustrating the relative position of fan 25 with respect to inlet opening 18 when fan assembly 20 is properly positioned for operation in enclosure 10. For purposes of illustration, the side wall of enclosure 10 has been deleted in FIG. 2. It should be noted that motor assembly plate 31, and all other plates attached to motor assembly plate 31 are of a length dimension substantially equal to the length of motor 30. These length dimensions are longer than necessary for adequately supporting motor 30 and fan 25, but serve a useful air flow directing function which improves the overall efficiency of the invention.

FIG. 3 shows a rear view of enclosure 10 with fan assembly 20 in place. A portion of rear flange 12 is opened to show the fit of door plate 40 against the side of enclosure 10. Extension 37 and 38 are each rigidly attached to door plate 40. Extension 38 is preferably formed from a right angle bend in cross plate 34, and vertical support 39 is preferably formed from an opposite right angle bend in cross plate 34. A further right angle bend in the same member can be used to form slide support 42, which is a critical feature of the present invention. Slide support 42 rests upon the interior surface of enclosure 10, and supports the entire fan assembly 20 in the position shown. Angle support plate 33 is rigidly attached to vertical support 39, and angled support plate 32 is rigidly attached at the intersection of extension 38 and cross plate 34. Similarly, angled support plate 35 and 36 are each rigidly attached at the respective ends of motor assembly plate 31. Angled support plate 36 serves no structural support function in the apparatus, being merely incorporated for the purpose of aiding in the direction of air flow through the apparatus. Therefore, it may be eliminated or modified without affecting structural strength, but it does serve a useful purpose in improving the efficiency of air flow through the apparatus. The angled end of angle support plate 36 may rest against the interior surface of enclosure 10, but is not attached to the surface.

From FIG. 3 it is apparent that fan assembly 20 is supported at two points: the lower surface of cross plate 34 rests upon edge 27 of opening 16, and vertical support 39 and slide support 42 rest the assembly on the inner surface of enclosure 10. Neither of these support points are fixed, and the fan assembly may be therefore slid outwardly by merely removing the bolts or screws holding door plate 40 against enclosure 10. The geometric arrangement of plates 31 – 36 is in a honeycomb pattern for structural reasons, and also to direct air flow from fan 25 linearly toward the rear end of enclosure 10. The air flow resulting from fan 25 is generally circular about the fan axis, although it has a downstream velocity component, to cause a generally helical air flow pattern through the rear of enclosure 10. When this air flow pattern impinges upon any of the plates 31 – 36 it becomes deflected into a directional flow downstream and is therefore more efficiently passed outward from the rear of enclosure 10.

As hereinbefore explained, vanes 15, attached along the interior edge of rear flange 12, provide further directional flow control for the air as it leaves enclosure 10. These vanes also ten to eliminate eddy current losses which normally occur along the inner surface of enclosure 10 and particularly in the regions of the interior corners of enclosure 10. Since eddy current losses represent lost energy and efficiency, the minimizing of eddy currents tends to improve air flow efficiency.

FIG. 4 shows an alternative embodiment wherein the fan motor is mounted external the door plate and is connected via a belt to the fan assembly which is positioned according to the teachings hereinbefore. This alternative embodiment is preferred in situations wherein the gas being conveyed through the ducting system is detrimental to motor operation. For example, if the duct work is conveying noxious fumes or dust laden air motor life may be severely shortened if the motor is operated in a flow path of the material being conveyed through the duct. The advantageous air flow principles described previously are equally applicable to this embodiment, as is the novel fan assembly mounting structure.

Figure 5:
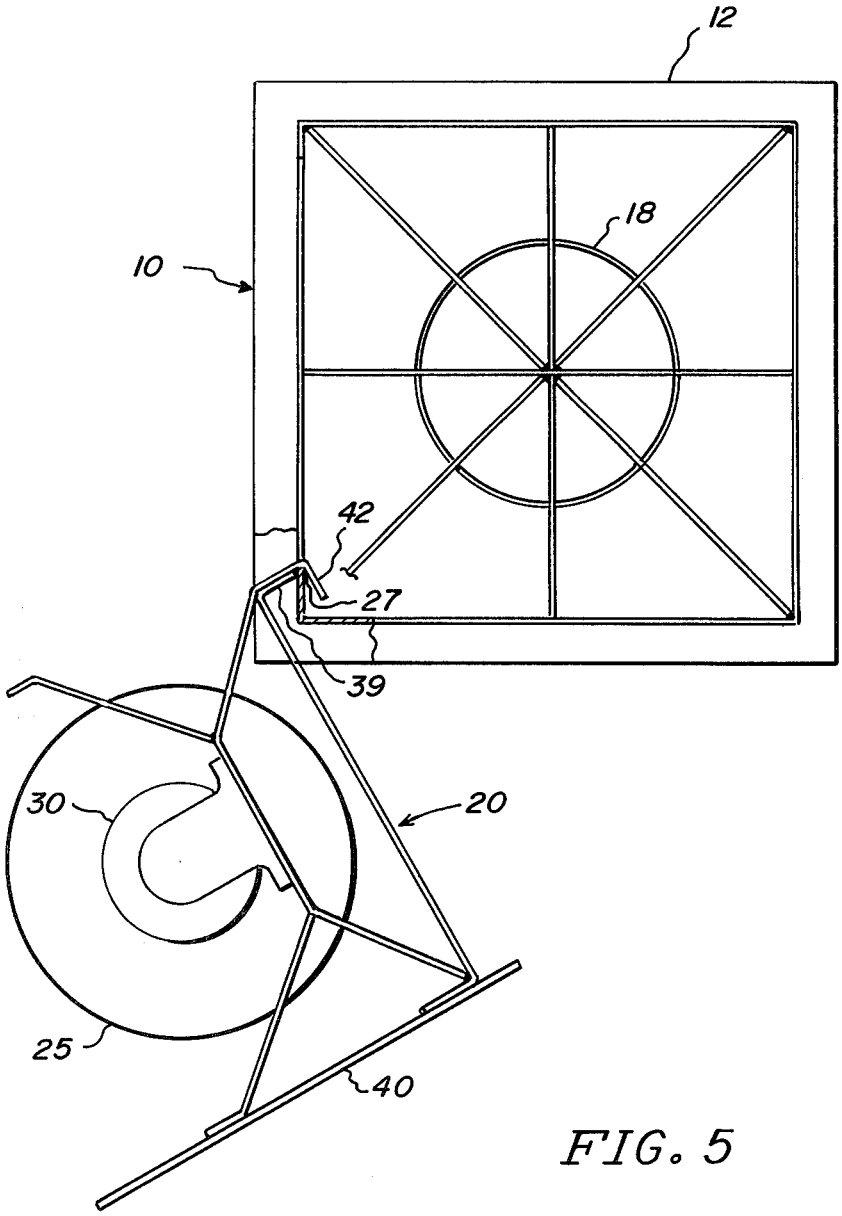
FIG. 5 shows an end view of the invention with the fan assembly fully opened.

FIG. 5 shows the apparatus of FIG. 3 in a fully opened position. Fan assembly 20 has been slid outwardly from within enclosure 10 and is pivotally dropped to a position hanging from edge 27 of enclosure 10. In this position, slide support 42 hooks the interior of enclosure 10 below edge 27 and prevents the fan assembly 20 from falling. The intersection of slide support 42 and vertical support 39 pivots about edge 27 and functions in the nature of a hinge. Fan assembly 20 may be pivotally rotated about this point for repair and maintenance, and the fan assembly may be entirely removed from enclosure 10 by merely lifting the fan assembly to clear slide support 42 from contact with edge 27. Similarly, to place a fan assembly into enclosure 10 it is only necessary to lift the fan assembly up so that slide support 42 passes over edge 27 to the inside of enclosure 10. The fan assembly may be then rotatably lifted and slid into enclosure 10 by sliding support 42 across the interior surface of enclosure 10. The mounting holes on door plate 40 are then aligned with corresponding holes in the side of enclosure 10 and locking bolts are secured to hold the fan assembly in place.

The present invention may be embodied in other specific forms without departing from the spirit or essential attributes thereof, and it is therefore desired that the preferred embodiment described herein be considered in all respects as illustrative and not restrictive, reference being made to the appended claims rather than to the foregoing description to indicate the scope of the invention.

What is claimed is:

1. An inline fan assembly and enclosure having an inlet and outlet adapted for coupling into a ducting system, comprising:

(a) an enclosure housing sized to match said ducting system and having a rectangular opening along a vertical side thereof, said opening positioned to provide a lower edge portion of said vertical side of a first predetermined dimension;

(b) a door plate sized larger than said rectangular opening and having means for attachment to said enclosure vertical side in closure relationship to said rectangular opening;

(c) a base support bracket having one of its ends extending into said enclosure and having an opposite end rigidly attached to said door plate at a position so as to rest said opposite end along said enclosure rectangular opening lower edge when said door plate is attached in closure relationship to said rectangular opening;

(d) U-shaped channel means for pivotally supporting said inline fan assembly about said enclosure housing lower edge portion, said U-shaped channel means being attached to said base support bracket end extending into said enclosure; and (e) a motor and fan mounting bracket attached to said base support bracket; and (f) a motor and fan assembly attached to said motor and fan mounting bracket in a position which places said fan in flow alignment with said enclosure inlet when said door plate is attached in closure relationship to said rectangular opening.

2. The apparatus of claim 1 wherein said motor and fan mounting bracket further comprises inclined plate members attached to said base support bracket and a motor attachment plate connected between said inclined plate members, wherein said motor attachment plate is substantially parallel to said base support bracket.

3. The apparatus of claim 2, further comprising a support bracket member extending from said motor attachment plate to said door plate in rigid attachment thereto.

4. The apparatus of claim 3, further comprising a plurality of vanes extending across said enclosure outlet, said vanes having surfaces in flow alignment with said ducting system.

5. The apparatus of claim 4, wherein said motor and fan mounting bracket, said support bracket member, and said base support bracket are of substantially equal width and also equal to the length of the motor attached to said motor and fan mounting bracket.

6. An inline fan assembly and enclosure for insertion into a gas flow ducting system, comprising:

(a) a rectangular enclosure having respective front and rear ends adapted for connection into said ducting system, the front end of said enclosure having a cover plate with an inwardly directed flange terminating in an inlet hole of predetermined diameter, and the rear end of said enclosure having a plurality of vanes extending across the enclosure in structural supporting relationship, each vane having a narrow dimension facing toward said enclosure front end and a wide dimension in flow alignment with said front end;

(b) an opening in a vertical side of said enclosure, said opening being located so as to have a vertical enclosure edge along its lower dimension;

(c) a door plate sized to cover said opening, said door plate having a cross plate rigidly attached thereto and extending perpendicularly therefrom into said enclosure at a position contacting said vertical enclosure edge when said door plate is covering said opening;

(d) a U-channel connected along said cross plate extending inside said enclosure, having a vertical member substantially equal in height to said vertical enclosure edge, whereby said U-channel pivotally supports said inline fan assembly about said vertical enclosure edge when said inline fan assembly is in an open position relative to said enclosure;

(e) a mounting bracket attached to said cross plate, said mounting bracket having upwardly inclining members attached proximate the ends of said cross plate and having a motor assembly plate attached between said members, said motor assembly plate being substantially parallel to said cross plate, the width of said mounting bracket being substantially equal to the width of said cross plate;

(f) an inclined support plate extending from said motor assembly plate to said door plate and being rigidly attached thereto; and (g) a motor and fan assembly attached to said motor assembly plate at a position placing said fan in alignment with said enclosure inlet hole when said door plate covers said enclosure vertical side opening.

7. The apparatus of claim 6, wherein the width of said mounting bracket and said cross plate is substantially equal to the length of said motor.

8. The apparatus of claim 7 wherein the number of said vanes extending across said enclosure is eight, and said vanes are spaced at equal angular separations.

9. The apparatus of claim 8, wherein each of said vanes has a width dimension of at least 2 inches.

* * * * *